United States Patent [19]

Shonley et al.

[11] Patent Number: 4,498,872

[45] Date of Patent: Feb. 12, 1985

[54] LIFESAVER TROLLING MOTOR MOUNT

[76] Inventors: Ivan T. Shonley, H.C. 55 Box 841; Orville J. Rock, H.C. 55 Box 877, both of Sturgis, S. Dak. 57785

[21] Appl. No.: 381,589

[22] Filed: Jul. 25, 1983

[51] Int. Cl.[3] ..... B63H 21/26

[52] U.S. Cl. ..... 440/63; 248/640

[58] Field of Search ..... 441/3, 53, 61, 63, 900; 248/640-643

[56] References Cited

U.S. PATENT DOCUMENTS

| | | | |
|---|---|---|---|
| 3,505,971 | 4/1970 | Dalke | 248/642 |
| 3,567,164 | 3/1971 | Hakala | 440/63 |
| 4,304,556 | 12/1981 | Wilson | 440/63 |

*Primary Examiner*—Trygve M. Blix
*Assistant Examiner*—Jesûs D. Sotelo

[57] ABSTRACT

A device for connecting the upper end of an auxiliary motor mount to the stern of an inboard/outboard boat when used in conjunction with a mount with pivotal lower anchoring device on the stern drive. The device allows full movement of the main drive both horizontally and vertically without impairing its movement or allowing the auxiliary motor to come in contact with or damage the stern of the boat in any position attainable by the stern drive, while allowing the operator to steer the auxiliary motor from either the pilot's compartment or with the individual controls of the auxiliary motor.

2 Claims, 3 Drawing Figures

LIFESAVER TROLLING MOTOR MOUNT

The present invention provides a mount for attaching an auxiliary motor which can be used as either an emergency or preferred source of power.

A wide range of motor boats have been provided in the past which perform valuable and different functions depending upon their design and the motive power provided. On occasion, such boats have included means for substituting auxiliary power for operation in special circumstances as, for example, a fishing boat used for trolling. In case of an emergency where the main source of motive power becomes inoperative, occupants of the boat may find themselves adrift without means of returning to shore unless rescued.

Among the objects of the present invention is the provision of a mounting device for attaching an auxiliary motor, pickaback, on the main motor and to the rear of a boat so that the auxiliary motor does not interfere with the normal operation of the boat, yet is readily operative when desired; the provision of a mount of the type indicated which permits operation of the boat, under either emergency conditions or as preferred, with the steering apparatus of the main motor or the individual controls of the auxiliary motor, while maintaining the customary maneuverability of the boat. Other objects and features will be in part apparent and in part pointed out hereinafter.

DESCRIPTION OF PREFERRED EMBODIMENT

Figure 1:
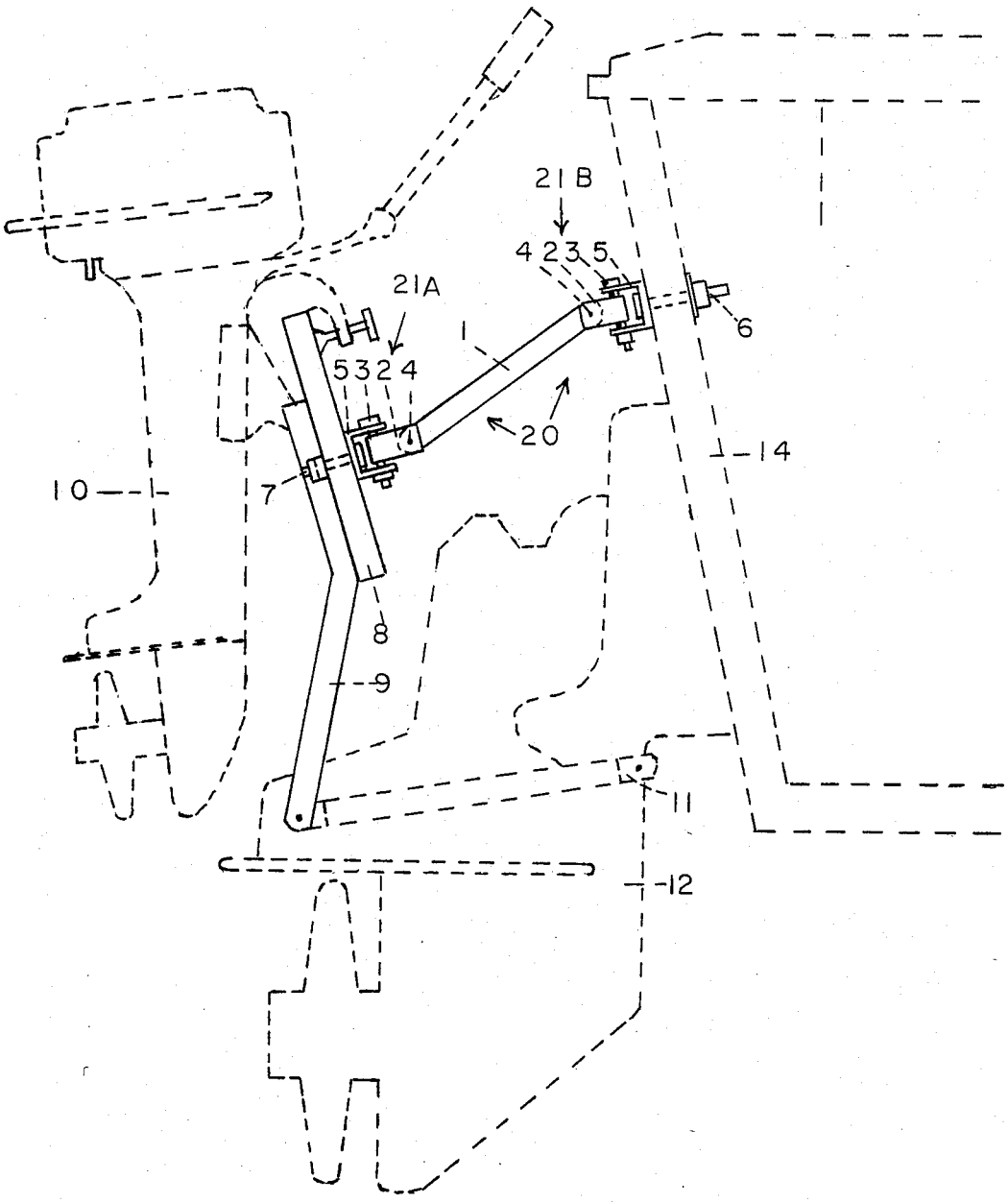
FIG. 1 is a side view of the rear of an inboard/outboard boat with the stern drive in lowered position with auxiliary motor attached utilizing the mount of the present invention.

Corresponding reference characters indicate corresponding parts throughout the several views of the drawings.

Figure 2:
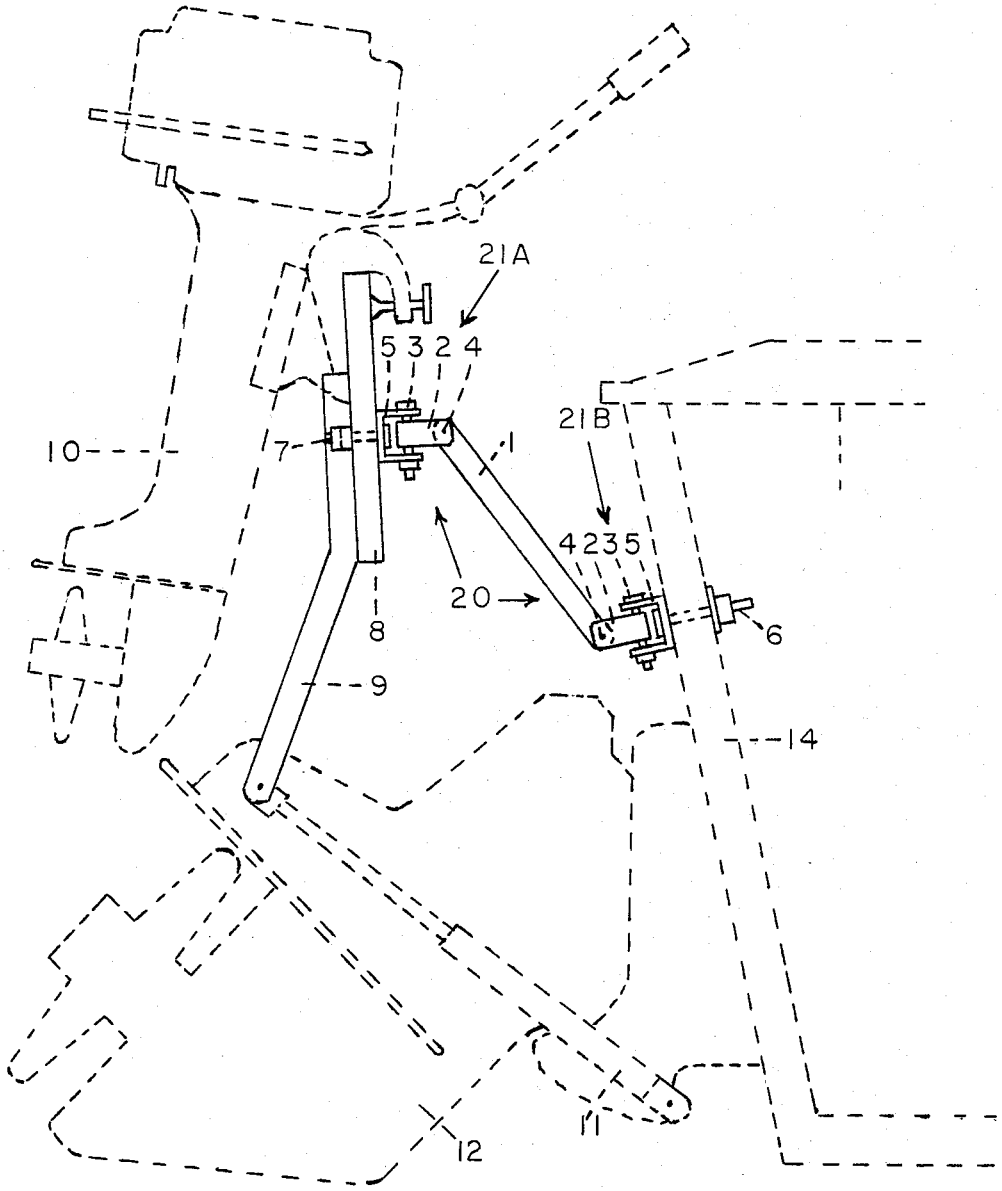
FIG. 2 is a side view of the rear of an inboard/outboard boat with the stern drive in raised position with auxiliary motor attached utilizing the mount of the present invention.
Figure 3:
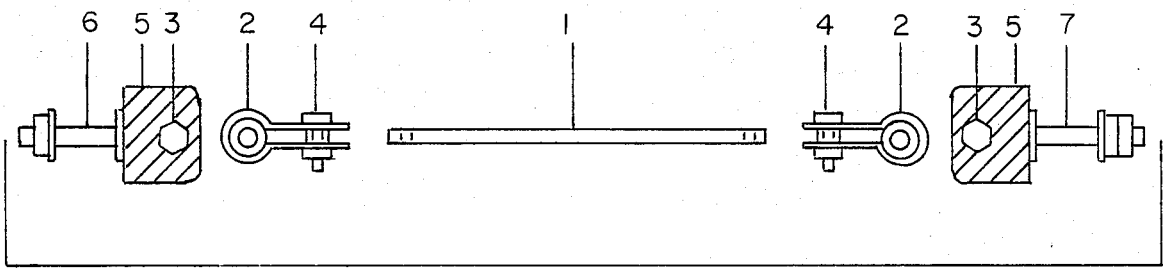
FIG. 3 is an exploded top view of the upper attaching device.

Referring now to the drawings, in FIG. 1 and FIG. 2 there is illustrated in broken lines the rear of a boat 14 equipped with a conventional inboard/outboard motor 12, to which is attached an auxiliary motor 10 utilizing motor mount 20. Motor mount 20 consists of one pair of legs 9A and 9B; a mounting board 8; two double swivels 21A and 21B and a connecting arm 1. Mount 20 is attached to main motor 12 which is the main drive unit of the type shown in FIG. 1 and FIG. 2, by means of legs 9A and 9B. Legs 9A and 9B are conveniently attached pivotally to the main drive by removing the nuts from stud bolts which connect the outer end of the hydraulic lift to the main drive unit and placing the lower end of the legs 9A and 9B over said stud bolts on each side of the main motor through holes in the lower ends of said legs, then replacing nuts on stud bolts; or by any other suitable means. Mounting board 8 is then attached to the upper end of the two legs with bolts through matching holes in the legs and mounting board. Mounting board 8 may be of solid wood or laminated plywood or any suitable structural material and should be treated to resist water absorption. The board is dimensioned appropriately to receive the conventional clamp portion provided on outboard motors. A hole is drilled through the transom of the boat where double swivel 21B is attached with bolt assembly 6. The other double swivel 21A is attached to the mounting board through hole provided with bolt assembly 7; this bolt is double nutted and left sufficiently loose to allow swivel to turn slightly in the mounting board so this assembly can move three ways to eliminate any binding when the main drive moves horizontally. The two swivels 21A and 21B are joined together by connecting arm 1 using bolt and bushing assemblies 4. Bushings function as both pivot points and spacers. Motor mount 20 will then support auxiliary motor clamped to the upper end of mounting board. Double swivels are constructed by using a channel iron 2"×2"×2" with a hole drilled in the center of the flat side of the channel and holes drilled through the center of the lips of the channel; a $\frac{1}{8}$"×$1\frac{1}{2}$"×6" strap iron is bent in the shape of a "U" and welded around a 2" joint of $\frac{1}{2}$" ID pipe which serves as bushing; holes are drilled through the outer ends of the strap iron to provide for means of attachment to the connecting arm 1. Other types of construction could be utilized provided the swivel principle is attained.

Motor mount 20 is preferably constructed of corrosion resistant material so that it will not rust and mounting board should be of either water resistant or treated material to prevent deterioration from lengthy contact with water.

This construction enables steering of the boat with either the controls of the main motor or the individual controls of the auxiliary motor. It also provides for movement of the main motor to its extremes both horizontally and vertically without allowing the auxiliary motor to come in contact with the stern of the boat thus preventing damage to either the boat or motor.

The configuration of the motor mount of the present invention enables it to support up to a 15 HP outboard motor to provide sufficient power to propel the boat for fishing or to safety in case of an emergency.

What is claimed is:

1. A motor mount for attaching an auxiliary motor of limited horsepower to a boat having a main drive unit which main drive unit is pivotably movable between an up position wherein the drive unit is raised out of the water, a down position wherein the drive unit is lowered into the water and has horizontal movement to both right and left of center, said motor mount comprising:

(a) a first leg having means at its lower end for pivotal connection to the upper portion of the said drive unit;

(b) a second leg having means at its lower end for pivotal connection to the upper portion of the said drive unit;

(c) a mounting board adapted to accept a clamping device on an auxiliary motor;

(d) said first and second legs being pivotably attached at their lower ends to opposite sides of main drive unit;

(e) said mounting board is attached to each leg at the upper end;

(f) a connecting arm connecting said mounting board to the transom of the boat;

(g) a first double swivel having means for bolting to the transom of the boat and means for attachment to one end of said connecting arm;

(h) a second double swivel having means for bolting to said mounting board and means for attachment to the other end of said connecting arm;

(i) said connecting arm having holes drilled through each end as a means to connect to said first and second double swivels.

2. A motor mount according to claim 1 which is mounted to the rear of the boat and the main drive unit and moves with the unit to its extremes both vertically and horizontally without coming in contact with the boat.

* * * * *